United States Patent [19]

Shannon

[11] Patent Number: 4,784,508

[45] Date of Patent: Nov. 15, 1988

[54] TABULAR DIVIDER SHEETS

[76] Inventor: Brian M. Shannon, P.O. Box 9392, Fountain Valley, Calif. 92708

[21] Appl. No.: 917,986

[22] Filed: Oct. 10, 1986

[51] Int. Cl.[4] ..... B42F 13/00; B42F 21/00; B42F 21/08; B42D 9/00

[52] U.S. Cl. ..... 402/79; 402/80 R; 281/42; 283/36

[58] Field of Search ..... 402/74, 80 P, 80 R, 402/79, 500, 502; 283/35, 36, 38, 39, 40; 40/360; D19/99

[56] References Cited

U.S. PATENT DOCUMENTS

| | | | |
|---|---|---|---|
| 529,477 | 11/1894 | Brown . | |
| 930,488 | 8/1909 | Martineau . | |
| 955,735 | 4/1910 | Wood . | |
| 968,065 | 8/1910 | Mehl . | |
| 983,090 | 1/1911 | Shepherd . | |
| 1,053,671 | 2/1913 | Stillwell . | |
| 1,924,755 | 8/1933 | Rubin | 283/36 |
| 2,502,785 | 4/1950 | Gottschalk . | |
| 2,601,853 | 7/1952 | Hirszon | 402/79 |
| 2,652,059 | 9/1953 | Wassell . | |
| 2,828,567 | 4/1958 | Shoan . | |
| 3,315,684 | 4/1967 | Karl | 402/79 |
| 3,324,823 | 6/1967 | Peters | 281/42 |
| 3,338,464 | 8/1967 | Calliman et al. | 402/74 |
| 3,794,550 | 2/1974 | Taillie | 402/79 |
| 3,895,453 | 7/1975 | Wright | 402/79 |
| 3,938,268 | 2/1976 | Gilhula | 283/36 |
| 4,031,647 | 6/1977 | Thomas . | |
| 4,247,999 | 2/1981 | Latino | 283/36 |
| 4,516,871 | 5/1985 | Leitman | 402/79 |
| 4,560,600 | 12/1985 | Yellin et al. . | |

FOREIGN PATENT DOCUMENTS

| | | | |
|---|---|---|---|
| 657843 | 5/1929 | France | 283/36 |

*Primary Examiner*—E. R. Kazenske
*Assistant Examiner*—Paul M. Heyrana, Sr.
*Attorney, Agent, or Firm*—Spensley Horn Jubas & Lubitz

[57] ABSTRACT

A tabular indexing system is provided having index insert sheets incorporating perforations defining a plurality of index tabs, so that unused index tabs may be removed from the insert sheets, and protective carries into which the index sheets are inserted. The index insert sheets are preferably the size of a full sheet of paper and may be used in photocopiers for making multiple sets of indexes. Index insert sheets having preformed, die-cut tabs also may be used. The protective carriers are suitable for use in loose-leaf binders or the like. The index insert sheets may be provided with perforations defining semicircular tabs that may be opened and used for holding additional sheets of paper on the insert to prevent the index tab from being covered.

10 Claims, 1 Drawing Sheet

PD 8073

TABULAR DIVIDER SHEETS

BACKGROUND OF THE INVENTION

1. Field of the Invention

This invention relates to tabular indexing systems and, more particularly, to indexing systems having tabular divider sheets for use in loose-leaf binders and the like.

2. Description of the Related Art

Index divider sheets with insertable index tabs have long been in use, primarily for placement in three-ring loose-leaf binders. Annual sales of such insertable index tab sheets are estimated at between 40 million and 50 million dollars, at wholesale. Such index tabs are well known to millions of school children and businessmen, who use them in dividing notebooks according to school subjects, reports according to chapters, and presentations according to sections, as well as any other use where a collection of materials must be subdivided into sections that can be easily accessed.

Such divider sheets, while being a great convenience, are not without their drawbacks. Divider sheets wherein the tab is incorporated into the divider sheet as a single piece of paper can be easily bent, become dog-eared, and eventually tear off. Paper divider sheets having a plastic tab that accepts a paper index insert almost universally use a platic that can crack, chip, and break. Also, inserting and removing the paper index inserts can be difficult and can result in destruction of the insert during the insertion. The legend which is to appear on the paper index insert must be individually written or typed, which is a time consuming and expensive task, especially if multiple sets of indexes are involved. Futhermore, the paper index inserts can fall out of the plastic tabs.

The divider sheets described above lose much of their convenience when multiple sets of divider sheets are required. If the tab is to be incorporated into a paper divider sheet, one still has the problem of tabs becoming bent and tearing off. If the divider sheet having a plastic tab is used, each paper insert must be individually indexed and inserted into the tab—a time consuming and tedious task.

SUMMARY OF THE INVENTION

The object of this invention is to provide a tabular indexing system that is easy to use and that protects the tab from wear.

The tabular indexing system of the present invention is designed to easily accept paper index inserts, making it easy to add and/or change information on the index tabs. The paper index inserts of the present invention are the size of a full sheet of paper, and are placed within insert index protective carriers that serve as divider sheets. The tab area of the paper inserts according to the present invention are larger than the tabs currently provided by standard index systems. Thus, more information can be included on the tab or the printing may be made larger. Because the index inserts are the size of a full sheet of paper, the tab area of the index inserts may be easily printed and/or photocopied, on one or both sides, for quick and easy construction of multiple sets of indexes. In addition, the full sheet area of the index insert may be used, on one or both sides, and likewise may be easily printed and/or photocopied.

Rather than applying the index legend by hand or typing, the paper index inserts can be typeset, if desired.

The protective carrier of the index inserts is preferably constructed of a polypropylene material so that it will not crack, chip, peel or tear as easily as the plastic tabs of standard tabular indexing systems. In addition, the polypropylene will not stick to photocopied materials. Becasue of the design of the protective carrier, a user can easily switch from white to colored or color-coded index insert sheets and back again. Furthermore, the protective carrier allows a user the option of using the full lengthwise edge of the paper index insert for the index information. The protective carrier can also be used as a sheet protector for pages on both sides of the index insert itself; construction of the protective carrier and of the index insert sheet prevents inserted materials from covering the index tab or falling out of the carrier in normal use.

The novel features that are believed to be characteristic of the present invention, both as to its organization and method of operation, together with further objectives and advantages thereof, will be better understood from the following description considered in connection with the accompanying drawings in which a presently preferred embodiment of the invention s illustrated by way of example. It is to be expressly understood, however, that the drawings are for the purpose of illustration and description only and are not intended as a definition of the limits of the invention.

DETAILED DESCRIPTION OF THE INVENTION

Figure 1:
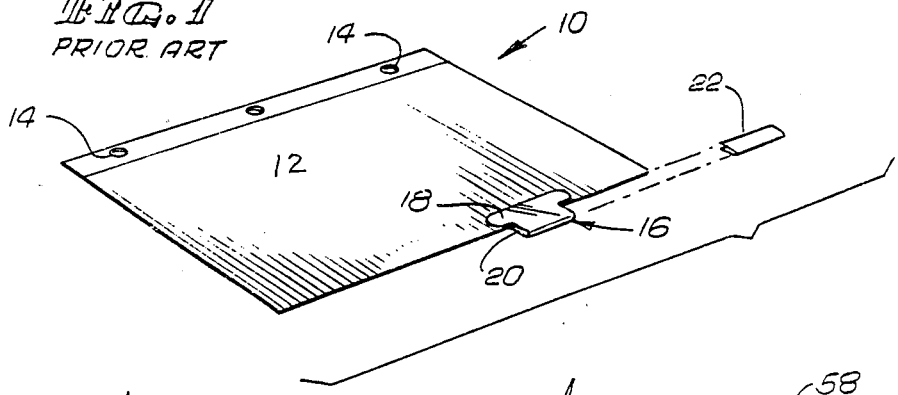
FIG. 1 PRIOR ART
FIG. 1 is a perspective view of the prior art index tab divider sheet.

FIG. 1 shows one type of prior art tabular index divider sheet. The index divider sheet 10 of the prior art consists of a paper divider sheet 12 generally of standard 8½ inch by 11 inch size but also available in other sizes, provided with a plurality of holes 14 at a first edge of the divider sheet 12. Typically, three holes are provided, to allow for easy insertion of the divider sheet into a three-ring loose-leaf binder. Many other sizes and numbers of holes are available. Attached at a second edge of the divider sheet opposite the holes is an index tab 16, generally made of a transparent plastic material that may be clear or may be tinted a color, as desired. Thus, the tab is placed on the outer edge of the divider sheet. In this way, the tabs may be easily viewed when placed in a notebook.

The index tab 16 is shown as the second position of a "1/5 cut", which has become an industry standard. A set of index divider sheets of 1/5 cut consist of five divider sheets, each sheet being provided with an index tab 16 at a different location along the outer edge of the divider sheet 12. Also available are index sheet sets having more than 5 tabs and having fewer than 5 tabs.

The plastic index tab 16 of the prior art is typically formed from a single narrow sheet of plastic with enlarged ends 18 that are glued to the divider sheet 12. Thus, the divider tab 16 is generally open at both top and bottom ends 20, so that an index insert 22, generally consisting of a folded over piece of paper, can be inserted into the tab 16.

Figure 2:
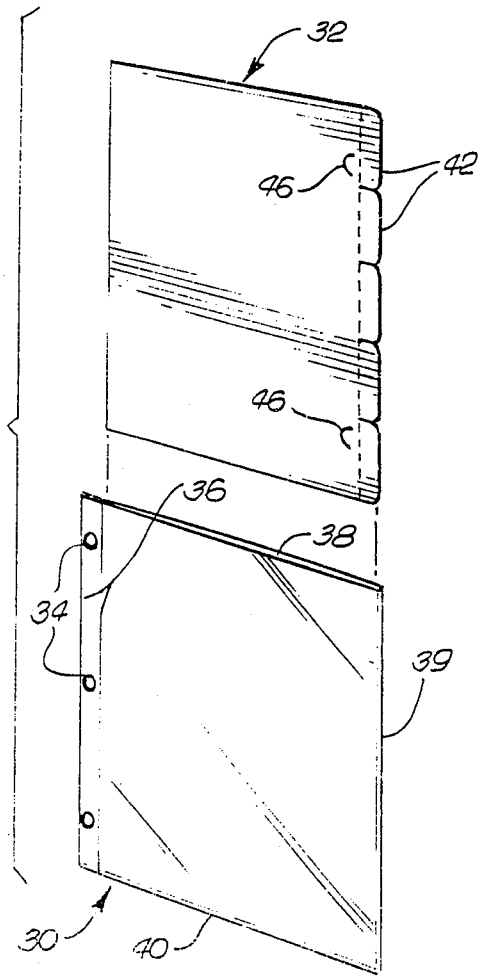
FIG. 2 is a perspective view of the index insert sheet and the insert carrier divider sheet of the present invention.

FIG. 2 shows the tabular indexing system of the present invention, which consists of a protective carrier 30 and an index insert sheet 32.

Figure 4:
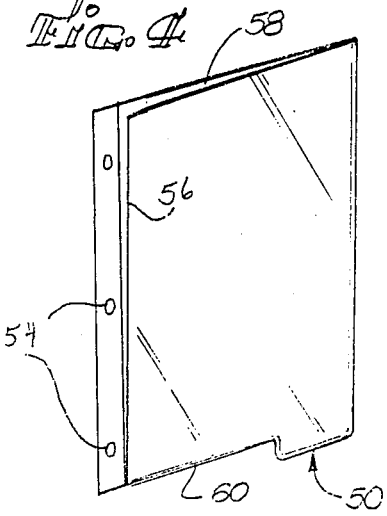

The protective carrier 30 is preferably constructed of transparent polypropylene, a flexible and durable plastic that will not stick to photocopied materials, and is provided along a first lengthwise edge with a plurality of holes 34 that allow for easy insertion in a loose-leaf binder or the like. The protective carrier 30 is typically formed from a single sheet of plastic that is folded over, thereby forming an outer edge 39, and may be bonded along lines 36. This forms an area within the folded portion of sufficient size to accept the index insert, which is shown in FIG. 2 as the size of a standard 8½ inch by 11 inch sheet of paper. The protective carrier 30 is typically open along a top edge 38 and is sealed along a bottom edge 40, thereby preventing sheets from sliding out of the protective carrier during normal use. Alternatively, the line 36 may define an open edge, with all other edges of the sheet 32 being sealed, or the protective carrier may be open along two adjoining edges, thereby forming an open corner for inserting sheets, as illustrated in FIG. 4 at edges 56 and 58.

The illustrated embodiment of the index insert 32 of the present invention is of 8½ inch by 11 inch dimension and of a weight allowing it to be used in most plain paper photocopy machines. In the illustrated embodiment, one lengthwise edge of the insert sheet 32 is provided with a plurality of tabs 42 formed by perforations 44 that allow selected tabs to be removed, using as few or as many tabs as desired on any single sheet 32. The index insert tabs of the present invention sold as 1/5 cut are larger than the industry standard 1/5 cut divider index tabs, and allow more room for the index legend.

Also provided on the index insert 32 of the present invention are holding tabs 46. The holding tabs 46 consist of a semicircular perforation on the index insert 32 that may be fully opened and bent away from the insert. Once the holding tab 46 is bent open, a sheet of paper may be placed on the index insert 32 with the edge of the paper placed under the raised holding tab 46 on either side of the index insert, thereby allowing the index insert and attached paper to be inserted into the protective carrier 30 without the paper shifting and covering the index tab.

Figure 3:
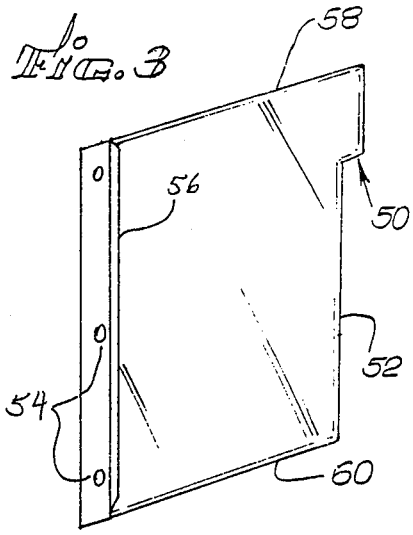
FIG. 3 and FIG. 4 are perspective views of alternative embodiments of the present invention.

Other embodiments of the present invention are contemplated and are considered to be within the scope of the present invention. For example, the protective carrier 30 may be of a construction as illustrated in FIG. 3. The carrier of FIG. 3 is ideally suited for use in a loose leaf binder filled with the protective carrier shown in FIG. 2. The FIG. 3 protective carrier has a projection 50 formed at the outside edge 52 opposite binder holes 54. Projections at various positions would be provided along the length of the outside edge 52, corresponding to the position of the tabs used. An index sheet 32 (as shown in FIG. 2) may be inserted from an open edge 56, the appropriate tabs 42 having been removed. The insert sheet may then be moved into its proper position, the remaining tab 42 being inserted into the projection 50. Alternatively, the protective carrier may be constructed with projections 50 formed along bottom edge 60, and in addition the protective carrier may be open along top edge 58 and adjoining edge 56. These last two features are both illustrated in the embodiment of FIG. 4.

The embodiments of the protective carrier shown in FIG. 3 and FIG. 4 eliminate the open, empty area created when the indexing system previously shown in FIG. 2 is used with one or more of the perforated tabs removed. These embodiments would also have application with, but not be limited to, index inserts having pre-printed, pre-cut tabs. Such inserts may be provided with index tabs reading "January" through "December" or "A" through "Z".

What is claimed is:

1. In a tabular indexing system having divider sheets placed between pages to be indexed, an indexing system having:

index insert sheets having index tabs along at least one edge; and protective carriers having an enclosed pocket area for carrying said index insert sheets, said protective carriers being closed along at least two edges, thereby defining the enclosed pocket area, open along at least a first edge for allowing insertion of the index insert sheets such that the tabs of the index insert sheets extend beyond the pages to be indexed.

2. The tabular indexing system of claim 1 wherein the index insert sheets have perforations along at least one edge defining a plurality of index tabs.

3. The tabular indexing system of claim 1 wherein the index insert sheets have semicircular perforations defining holding tabs, located adjacent the index tabs, that may be bent away from the index insert sheet on either side, thereby preventing a sheet of paper placed on either side of the index insert sheet under the bent holder tab from shifting so as to cover an index tab.

4. The tabular indexing system of claim 1 wherein the index insert sheets have projecting portions forming index tabs and the protective carriers are provided with projecting portions along an edge, the enclosed pocket area of the protective carrier including the projecting portion, such that the said projecting portions accomodate the projecting index tabs of the index insert sheets.

5. The tabular indexing system of claim 1 wherein the protective carriers are constructed of polypropylene.

6. The tabular indexing system of claim 1 wherein the protective carrier is open along two adjacent edges for allowing insertion of the index insert sheets.

7. The tabular indexing system of claim 1 wherein the protective carriers have a plurality of holes along one edge for receiving the rings of a multiple ring binder.

8. In a tabular indexing system having divider sheets placed between pages to be indexed, the indexing system with divider sheets comprising:

index insert sheets having index tabs along at least one edge, the index insert sheets being of the same size as the pages to be indexed; and protective carriers having an enclosed pocket area for receiving the index insert sheets, said protective carriers being closed along the periphery of at least two edges thereby defining the enclosed pocket area, and open along at least a first edge for allowing insertion of the index insert sheets such that the index tabs along at least one edge of the index insert sheets extend beyond the pages to be indexed.

9. The indexing system of claim 8 wherein the protective carriers are formed from a single sheet of polypropylene folded over on itself and having a plurality of holes along one edge for receiving the rings of a multiple ring binder.

10. The indexing system of claim 8 wherein the protective carriers are formed of two sheets of plastic and having a plurality of holes along one edge for receiving the rings of a multiple binder.

* * * * *